US006549172B1

(12) United States Patent
Thevenot et al.

(10) Patent No.: US 6,549,172 B1
(45) Date of Patent: Apr. 15, 2003

(54) ANTENNA PROVIDED WITH AN ASSEMBLY OF FILTERING MATERIALS

(75) Inventors: Marc Thevenot, Peyrilhac (FR); Bernard Jean-Yves Jecko, Rilhac Rancon (FR); Alain Jean-Louis Reineix, Rilhac Rancon (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 0 days.

(21) Appl. No.: 09/889,517

(22) PCT Filed: Nov. 17, 2000

(86) PCT No.: PCT/FR00/03205

§ 371 (c)(1),
(2), (4) Date: Jul. 18, 2001

(87) PCT Pub. No.: WO01/37373

PCT Pub. Date: May 25, 2001

(30) Foreign Application Priority Data

Nov. 18, 1999 (FR) ..... 99 14521

(51) Int. Cl.[7] ..... H01Q 19/00
(52) U.S. Cl. ..... 343/756; 343/909; 333/202
(58) Field of Search ..... 343/756, 840, 343/909, 753, 911 R, 911 L; 333/202, 134

(56) References Cited

U.S. PATENT DOCUMENTS

| | | | | | |
|---|---|---|---|---|---|
| 3,331,073 | A | * | 7/1967 | Horst | 343/755 |
| 4,755,820 | A | * | 7/1988 | Backhouse et al. | 343/700 MS |
| 5,386,215 | A | * | 1/1995 | Brown | 343/792.5 |
| 5,389,943 | A | * | 2/1995 | Brommer et al. | 333/202 |
| 5,398,037 | A | * | 3/1995 | Engheta et al. | 343/753 |
| 5,471,180 | A | | 11/1995 | Brommer et al. | 333/202 |
| 5,528,254 | A | * | 6/1996 | Howng et al. | 343/753 |
| 5,541,613 | A | | 7/1996 | Lam et al. | 343/792.5 |
| 5,600,342 | A | * | 2/1997 | Pikulski et al. | 343/795 |
| 5,679,604 | A | | 10/1997 | Pikulski et al. | 437/188 |
| 5,712,648 | A | * | 1/1998 | Tsujiguchi | 333/134 |
| 5,739,796 | A | | 4/1998 | Jasper, Jr. et al. | 343/895 |

FOREIGN PATENT DOCUMENTS

| | | |
|---|---|---|
| GB | 1 555 756 | 11/1979 |
| WO | WO 95/33287 | 12/1995 |
| WO | WO 96/29621 | 9/1996 |

OTHER PUBLICATIONS

Yang et al., "Photonic Band–Gap Materials for High–Gain Printed Circuit Antennas", IEEE Transactions on Antennas and Propagation, US, IEEE Inc. New York, vol. 45, No. 1, 1999, pp. 185–187.

* cited by examiner

*Primary Examiner*—Tan Ho
(74) *Attorney, Agent, or Firm*—Young & Thompson

(57) ABSTRACT

An antenna includes a probe capable of transforming electrical energy into electromagnetic energy and inversely. It further includes an assembly of elements made of at least two materials different in permittivity and/or permeability and/or conductivity within which the probe is arranged, the arrangement of the elements in the assembly ensuring radiation and spatial and frequency filtering of the electromagnetic waves produced or received by the probe, which filtering allows in particular one or several operating frequencies (f) of the antenna inside a frequency band gap (B).

17 Claims, 5 Drawing Sheets

—— $\varphi=0$

---- $\varphi=\frac{\pi}{2}$

ANTENNA PROVIDED WITH AN ASSEMBLY OF FILTERING MATERIALS

BACKGROUND OF THE INVENTION

The present invention relates to a transmitting or receiving antenna which attains high levels of directivity at frequencies in the microwave range.

Antennas are known which comprise at least one probe capable of transforming electrical energy into electromagnetic energy and vice versa.

Nowadays, the antennas conventionally used are, in particular, parabolic reflector antennas, lens antennas and horn antennas.

Parabolic reflector antennas comprise a reflecting plane which is parabolic in shape, at the focus of which is located a probe. This requires the antenna to be of a certain size related to the focal length of the parabolic reflector.

Lens antennas comprise a lens at the focus of which is located a probe. Apart from the considerable size caused by the focal length, an antenna of this kind is also heavy, owing to the weight of the lens, and this weight may be prohibitive for certain applications.

Horn antennas have to be bulky and heavy to achieve high levels of directivity.

SUMMARY OF THE INVENTION

The invention sets out to overcome the disadvantages of conventional antennas by creating an antenna which is less bulky and lighter, while being capable of transmitting or receiving an electromagnetic wave with high levels of directivity.

The invention thus relates to an antenna comprising at least one probe capable of transforming electrical energy into electromagnetic energy and vice versa, characterised in that it further comprises an assembly of elements made of at least two materials differing in their permittivity and/or permeability and/or conductivity, within which said probe is arranged, the arrangement of the elements in said assembly ensuring radiation and spatial and frequency filtering of the electromagnetic waves produced or received by said probe, said filtering allowing in particular one or more operating frequencies of the antenna within a frequency band gap.

This antenna consequently allows a reduction in size and weight by using a simplified feed system and a thin assembly of elements made of materials differing in their permittivity and/or permeability and/or conductivity.

The antenna according to the invention may also have one or more of the following features:

Said assembly of elements has a periodicity with at least one dimension in its structure and at least one defect which generates at least one cavity inside it.

Said assembly of elements comprises a first material of a given permittivity and permeability and conductivity, forming a cavity inside a structure of two other materials which differ in their permittivity and/or permeability and/or conductivity, said structure having a triple periodicity in three distinct spatial directions of the other two materials.

Said assembly of elements comprises a first material of a given permittivity and permeability and conductivity, forming a cavity inside a structure of two other materials which differ in their permittivity and/or permeability and/or conductivity, said structure having a double periodicity in two distinct spatial directions of the other two materials.

Said assembly of elements is made up of flat layers of materials differing in their permittivity and/or permeability and/or conductivity.

Said assembly of elements comprises a first flat layer of material of a given permittivity and permeability and conductivity, inside which is arranged the probe, said first layer being in contact with at least a succession of flat layers of material differing in their permittivity and/or permeability and/or conductivity, arranged An a one-dimensional periodic pattern.

It further comprises a planar reflector of electromagnetic waves supporting said probe and placed in contact with said assembly of elements.

It comprises a metal plate on which is arranged a probe, said metal plate forming a planar reflector in contact with a first flat layer of material of a given permittivity and permeability and conductivity, the thickness $e_1$ of said first flat layer being given by the equation $e_1=0.5\ (\lambda/\sqrt{\epsilon_r\mu_r})$, said first layer itself being in contact with a succession of flat layers of materials differing in their permittivity and/or permeability and/or conductivity, the thickness e of each of said flat layers being given by the equation $e_1=0.25\ (\lambda/\sqrt{\epsilon_r\mu_r})$, where lambda is the wavelength corresponding to the operating frequency of the antenna wanted by the user, $\epsilon_r$ and $\mu_r$ being, respectively, the relative permittivity and the relative permeability of the material of the flat layer in question.

The invention will be more easily understood from the description which follows, provided solely by way of example and referring to the accompanying drawings, wherein:

DESCRIPTION OF THE PREFERRED EMBODIMENTS

Figure 1:
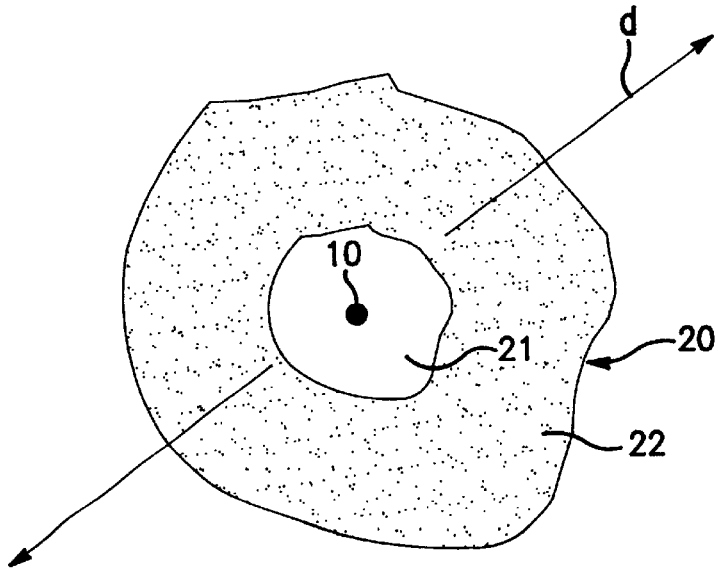
FIG. 1 shows an antenna according to the invention, in its general form.

An antenna according to the invention as shown in FIG. 1 comprises:

a probe 10 capable of transforming an electrical wave into an electromagnetic wave and vice versa. Antennas such as plate antennas, dipole antennas, circular polarisation antennas, slot antennas and coplanar plate wire antennas, for example, may be suitable for use as the probe 10 in an antenna according to the present invention.

An assembly 20 of elements made of at least two materials differing in their permittivity and/or permeability and/or conductivity, within which the probe 10 is arranged. Materials with lowlosses will preferably be used, such as plastics, ceramics, ferrite, metal, etc.

One advantage of the present invention is that the probe 10 may be very simple in design provided that it fulfils the type of polarisation (linear or circular), the ellipticity level and electrical characteristics required by the designer, while at the same time this probe 10 must be small in relation to the overall dimensions of the antenna.

One benefit of the assembly 20 is that it makes it possible to design an antenna which permits one or more propagation frequency modes within a band gap, in one or more authorised spatial directions d, the spatial filtering itself depending on the frequency and nature of the materials which the assembly 20 contains.

Another advantage of this assembly 20, comprising a structure 22 designed on the principle of materials with a forbidden photon band within which are found one or more cavities 21, is that it has one or more propagation frequency modes which are very well insulated from their nearest neighbours.

A structure designed on the principle of materials with a forbidden photon band is a structure of elements differing in their permittivity and/or permeability and/or conductivity, this structure having at least a one-dimensional periodicity.

A cavity 21 placed inside the assembly 20 gives it, by association with the material with a forbidden photon band 22, the behaviour of a material known in the art as a defect forbidden photon band material.

It may be:

- a local modification in the dielectric and/or magnetic and/or conductivity characteristics of the materials used,
- a local modification in the dimensions of one or more materials.

Figure 2:
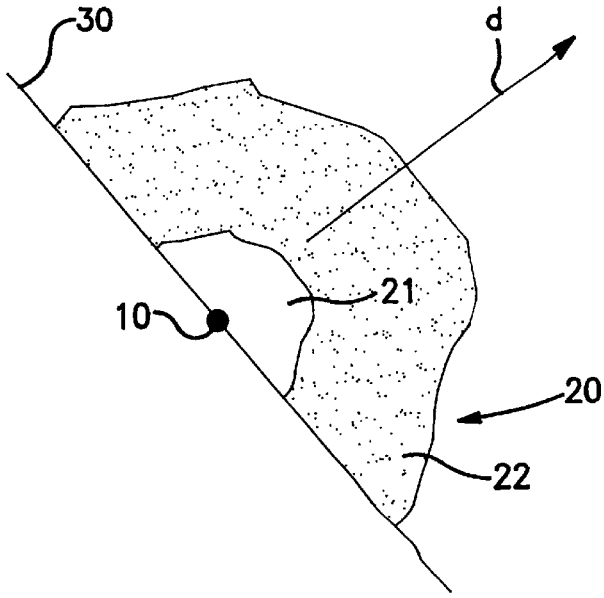
FIG. 2 shows an antenna according to the invention comprising a plane for reflecting electromagnetic waves.

An antenna according to the invention as shown in FIG. 2 may also comprise an electromagnetic reflecting plane 30 placed in the middle of the assembly 20 and containing the probe 10, making it possible to reduce the dimensions of the antenna by half, particularly when the radiation is only useful in a half-space.

One benefit of an antenna according to the invention comprising an electromagnetic reflecting plane 30 is that it increases the gain in the major lobe of the directivity diagram of said antenna.

Figure 3:
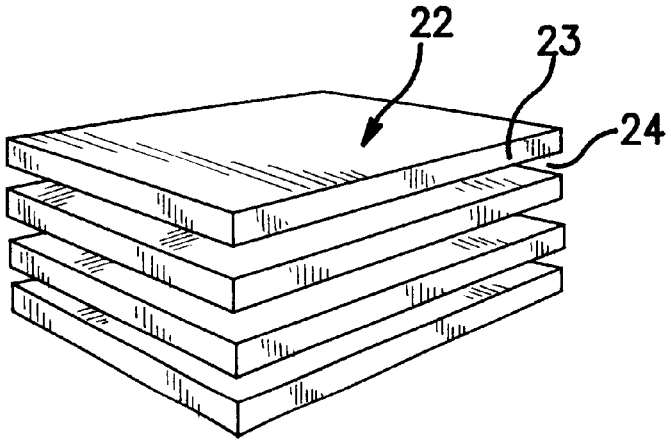
FIG. 3 is a schematic perspective view of an embodiment of a structure of flat layers of materials differing in their permittivity and/or permeability and/or conductivity, arranged in a one-dimensional periodic pattern.

An antenna according to the invention shown in FIG. 3 comprises a structure 22 based on the principle of materials with a forbidden photon band having periodicity in one dimension, i.e. said structure 22 comprises alternating flat layers of two materials 23 and 24, e.g. aluminium oxide and air, respectively, which differ in their permittivity and/or permeability and/or conductivity.

Figure 4:
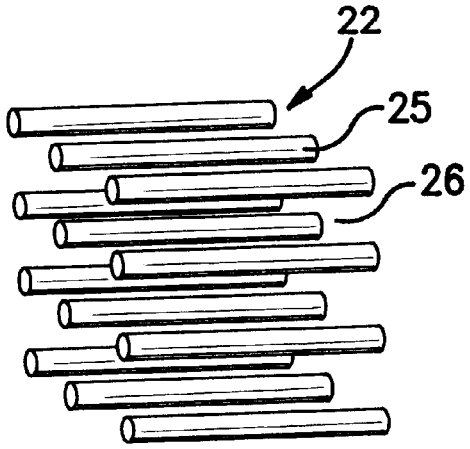
FIG. 4 is a schematic perspective view of an embodiment of a structure having a double periodicity in two distinct spatial directions of the materials which constitute it.

An antenna according to the invention shown in FIG. 4 comprises a structure 22 based on the principle of the forbidden photon band materials having two-dimensional periodicity, i.e. said structure 22 comprises regularly disposed cylindrical bars of a first material 25, e.g. aluminium oxide, separated from one another by a second material 26, e.g. air, the second material differing from the first in its permittivity and/or permeability and/or conductivity.

For example, the structure is made up of cylindrical bars arranged in a succession of superimposed layers.

In each layer, the bars extend parallel to one another and are arranged at regular spacings.

Moreover, the bars in successive layers are aligned at regular spacings. The bars are preferably made of metal.

Figure 5:
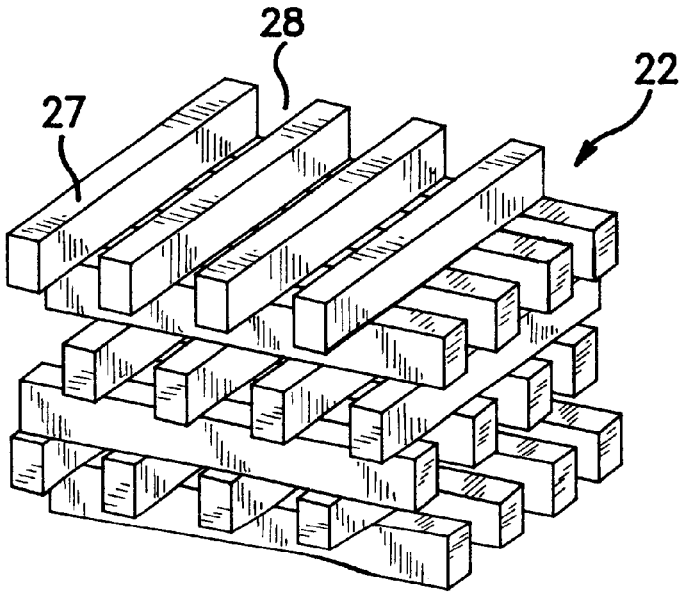
FIG. 5 is a schematic perspective view of an embodiment of a structure having a triple periodicity in three distinct spatial directions of the materials which constitute it.

An antenna according to the invention as shown in FIG. 5 comprises a structure 22 based on the principle of materials with a forbidden photon band having three-dimensional periodicity, such that said structure 22 comprises uniformly arranged alternating bars, e.g. cuboid in shape, of a first material 27, e.g. aluminium oxide or metal, separated from one another by a second material 28, e.g. air, the second material differing from the first in its permittivity and/or permeability and/or conductivity.

For example, the structure 22 is made up of substantially cuboid bars arranged in a stack of superimposed layers. In each layer, the bars extend parallel to one another and are placed at regular spacings and the bars of two adjacent layers form a constant angle, e.g. an angle of 90°.

Moreover, the bars in layers separated by an intermediate layer are parallel to one another and aligned at regular intervals.

Figure 6:
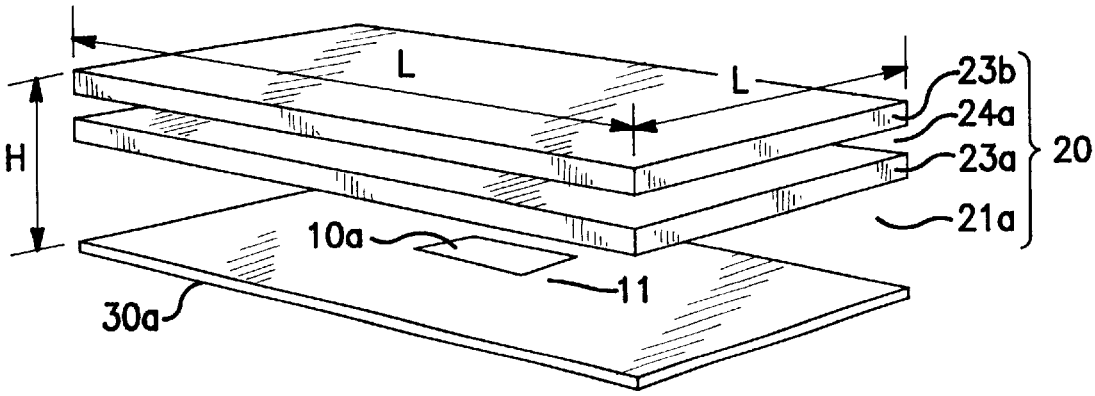
FIG. 6 is a schematic perspective view of an antenna according to a particular embodiment of the invention.

Referring to FIG. 6, a preferred embodiment of an antenna according to the present invention comprises:

- A plate probe 10*a* using a single feed wire 11; one advantage of this probe is that it is very simple in construction and limits the metal and dielectric losses of the antenna.
- A metal plate forming a planar electromagnetic reflector 30*a;*
- A flat layer forming a cavity 21*a* in contact with the planar reflector 30*a,* said cavity 21*a* consisting of a material, preferably of low permittivity or permeability so as to limit the guiding of the surface waves, while this material may be air as shown in FIG. 6 by way of example;
- A structure 22 the materials 23*a,* 24*a,* 23*b* of which, differing in their permittivity and/or permeability and/or conductivity, are arranged in successive flat layers in a one-dimensional periodic pattern.

The number of periods which may be of use in the direction at right angles to the plane of the antenna depends on the contrasts in permittivity and/or permeability and/or conductivity of the materials used. To reduce the number of periods, the index contrasts between the different materials have to be increased.

For example, in the embodiment shown in FIG. 6, the materials used are aluminium oxide with a high permittivity index and air with a low permittivity index, enabling the structure 22 to have only three layers of material.

The structure 22 thus consists of a first flat layer 23*a* of aluminium oxide in contact with a second flat layer 24*a* of air, which is in turn in contact with a third flat layer 23*b* of aluminium oxide.

In the embodiment as shown in FIG. 6, in which the assembly 20 of successive flat layers of dielectric or magnetic material, where the first layer 21*a* constitutes the cavity and where the following layers 23*a,* 24*a* and 23*b* constitute the structure 22:

a) The thickness $e_{21a}$ of the flat layer 21*a* consisting of a material having a relative permittivity $\epsilon_r$ and a relative permeability $\mu_r$ is given by the formula $e_{21a} \sim 0.5\ (\lambda/\sqrt{\epsilon_r \mu_r})$, where $\lambda$ is the wavelength corresponding to the operating frequency of the antenna, and where the symbol "~" denotes "equal or substantially equal to".

By way of example, the thickness of the flat layer of air 21*a* shown in FIG. 6 is equivalent to $e_{21a}=0.5\ \lambda$.

b) The thickness e of a flat layer of a dielectric or magnetic material having a relative permittivity $\epsilon_r$ and a relative permeability $\mu_r$ within the structure 22 is given by the formula $e \sim 0.25\ (\lambda/\sqrt{\epsilon_r \mu_r})$.

By way of example, the thickness of the flat layer of aluminium oxide 23*a* shown in FIG. 6 is equivalent to $e_{23a}=0.08\ \lambda$; the thickness of the flat layer of air 24*a* shown in FIG. 6 is equivalent to $e_{24a}=0.25\ \lambda$; the thickness of the flat layer of aluminium oxide 23*b* shown in FIG. 6 is equivalent to about $e_{23b}=0.08\ \lambda$.

c) The lateral dimensions of the structure 22, the plate 30*a* and the cavity 21*a* are chosen as a function of the gain required of the antenna. The useful form for the antenna is inscribed in a circle the diameter $\Phi$ of which is connected to the desired gain, according to the following known empirical formula: $G_{dB} \geqq 20\log(\pi\Phi/\lambda)-2.5$.

Figure 8:
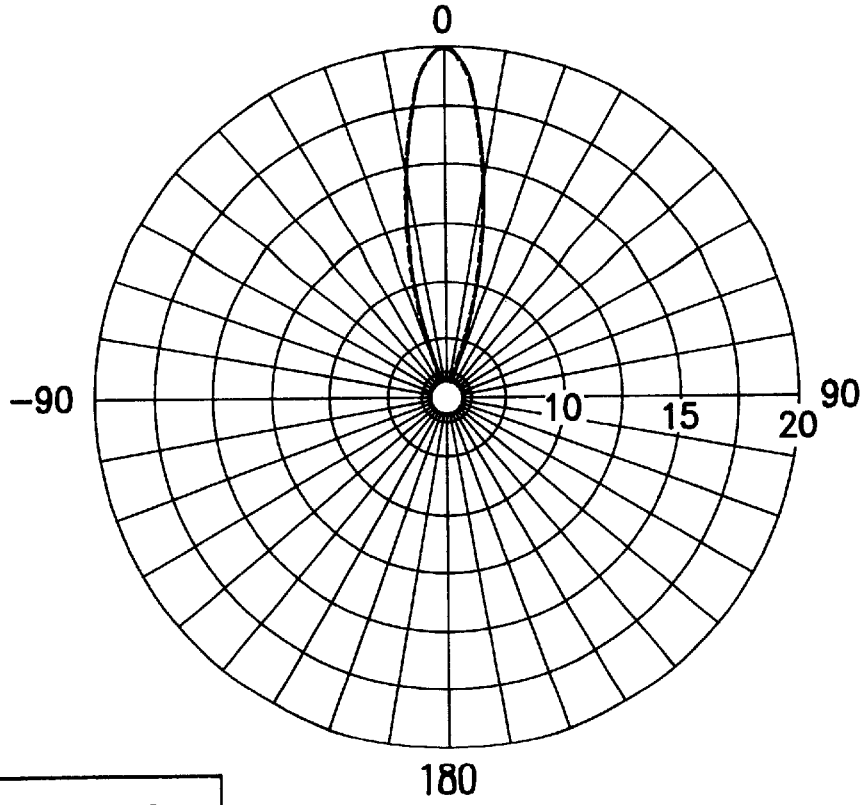
FIG. 8 shows a diagram of the directivity of the antenna according to the embodiment shown in FIG. 6.

For example, to obtain a gain of 20 dB as shown in FIG. 8, an antenna system according to the invention may have sides measuring 4.3 $\lambda$. The lateral shape of the antenna is then chosen so as to obtain a certain shape of radiation of the antenna, using a known process.

d) Taking account of the lateral dimensions and thicknesses of the different layers of materials used in the composition of the antenna as described in FIG. 6, said thicknesses and lateral dimensions being mentioned above, the general dimensions of the antenna are therefore: a thickness H of about $\lambda$ and a lateral dimension L of 4.3 $\lambda$. Thus, for an operating frequency of 10 GHz corresponding to a wavelength of 3 cm, one particular embodiment of an antenna according to the present invention as shown in FIG. 6 will have a volume of the order of $3\times13\times13\ cm^3$, whereas a conventional dish antenna system operating at the same frequency of 10 GHz which has a focal length of about 70 cm takes up significantly more space.

It is thus clear that the present invention certainly helps to solve the problem of size connected with antennas, due chiefly to the thinness of an antenna according to the invention.

Moreover, given that the thickness of the successive flat layers of an antenna according to the invention as described in FIG. 6 is proportional to $\lambda$ and hence inversely proportional to the operating frequency of the antenna, this realisation makes it possible to design an antenna operating at very high frequency using multilayer technologies.

Figure 7:
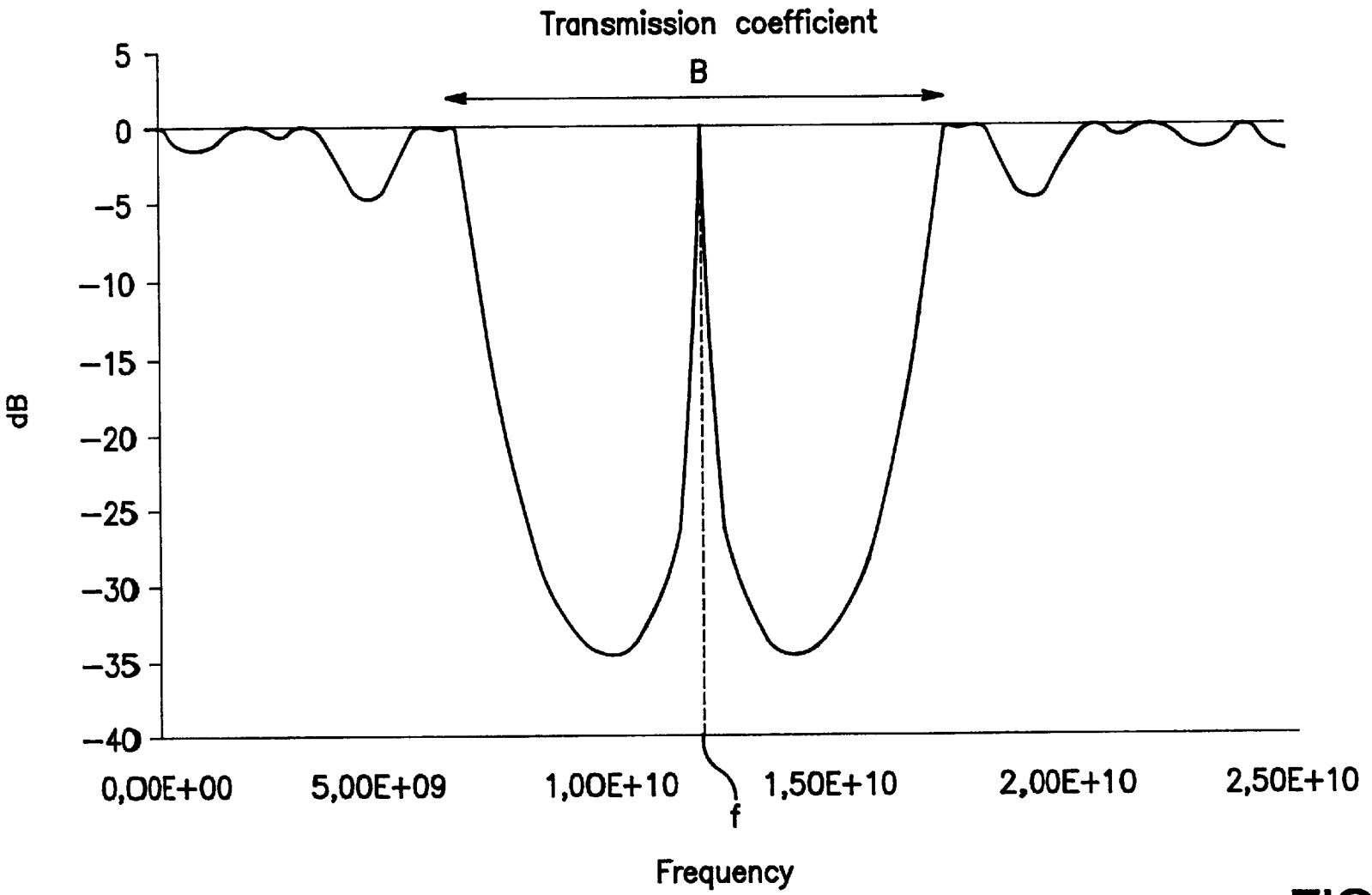
FIG. 7 shows a curve giving the coefficient of transmission as a function of the frequency of the electromagnetic wave transmitted or received by an antenna according to the invention.

An antenna according to the invention as shown in FIG. 6 ensures that the electromagnetic waves produced or received by said antenna will be radiated and subjected to spatial and frequency filtering, as shown in FIG. 7. This filtering allows, in particular, one or more operating frequencies f of said antenna within a frequency band gap B.

An antenna according to the invention as shown in FIG. 6 is designed to achieve a gain of 20 dB and has a radiation diagram as shown in FIG. 8.

It appears that the antenna according to the invention will achieve substantial gains in a given direction, like conventional aperture antennas.

It is also clear that this radiation diagram has low levels of secondary lobes.

The operation of the antenna described with reference to FIG. 6 will now be examined. The antenna has two operating modes: a transmitting mode and a receiving mode.

In transmitting mode, an electric current carried by the feed wire 11 reaches the probe 10*a* which converts it into an electromagnetic wave. This electromagnetic wave then passes through the assembly 20 of elements made of materials which differ in their permittivity and/or permeability and/or conductivity, the arrangement of which allows spatial and frequency filtering of the electromagnetic wave by construction, thereby shaping the radiation diagram of the antenna system depending on the properties required by the user.

In receiving mode, an electromagnetic wave reaching the antenna is spatially and frequency filtered as it passes through the assembly 20 of elements made of materials which differ in their permittivity and/or permeability and/or conductivity, before it can reach the probe 10*a*. Then the electromagnetic wave, filtered depending on the properties required by the user by construction of the antenna, is converted into an electric current by the probe 10*a* and transmitted to the feed wire 11.

According to one particular embodiment, the probe of the antenna is naturally capable of generating linear or circular polarisation in the antenna, causing the latter to operate either by linear polarisation or by circular polarisation.

According to another particular embodiment, the shape of the flat layers is designed so as to obtain the desired radiation and gain diagram in accordance with radiant aperture theory.

According to yet another embodiment, the elements which make up the structure are coaxial cylinders surrounding the probe, the arrangement thus having radial periodicity, and the inner cylindrical element forms a cavity receiving said probe.

According to yet another embodiment, the elements which make up the structure 22 are coaxial cylinders consisting of materials with a forbidden photon band having periodcity in two or three dimensions.

According to yet another embodiment of the invention, at least one of the materials has dielectric and/or magnetic characteristics which are variable as a function of an external source such as an electrical or magnetic field, so as to make it possible to produce tuneable aerials.

According to a further feature of the invention, the assembly has multiple periodicity-defects generated by a cavity or the juxtaposition of a number of cavities and making it possible to widen the pass band of the antenna and/or create multiband antennas.

Finally, according to another embodiment of the invention, the assembly of elements 20 has a periodicity with at least one dimension and at least one defect in one dimension of this periodicity which generates at least one cavity inside it, the elements continuing to be arranged at regular spacings in the other dimensions.

Figure 9:
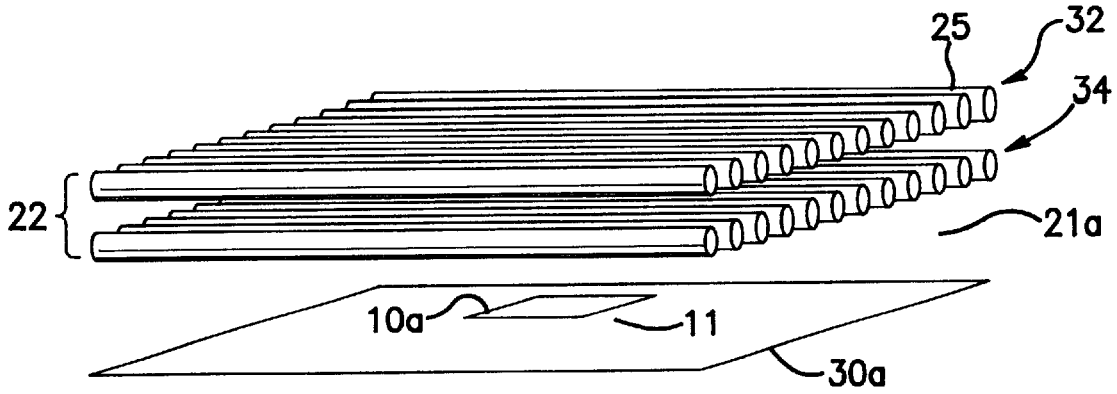
FIG. 9 is a schematic perspective view of an antenna according to another embodiment of the invention.

Thus, the antenna shown in FIG. 9 comprises:

a plate probe 10*a* using a single feed wire 11;

a metal plate forming a planar electromagnetic reflector 30*a;* a flat layer forming a cavity 21*a* in contact with the planar reflector 30*a,* identical to that shown in FIG. 6; and a structure 22 in contact with the flat layer forming cavity 21*a*.

This structure has a two-dimensional periodicity: it comprises cylindrical bars 25 arranged in two identical superimposed layers 32 and 34. In each layer 32 and 34, the bars 25 extend parallel to one another and are arranged at a regular spacing.

Thus, the assembly 20 consisting of the cavity 21*a* and the structure 22 has a defect in its periodicity, in the dimension corresponding to the direction perpendicular to the planar reflector 30*a* and the layers 32 and 34. By contrast, the periodic arrangement of the bars 25 in each layer 32 and 34 is not affected by the presence of the cavity 21*a*.

Moreover, the dimensions of this antenna are dependent on the operating frequency for which it was designed. For example, to operate at a frequency of 4.75 GHz, the lateral dimensions of the antenna are 258 mm, the thickness of the cavity 21*a* is 33.54 mm, the two layers 32 and 34 are spaced 22.36 mm apart and in each layer the bars 25 are 10.6 mm in diameter and their respective axes are spaced 22.36 mm apart.

The bars may consist of dielectric, magnetic or metallic materials.

Under these conditions, the antenna shown in FIG. 9, like the one shown in FIG. 6, has a radiation diagram as shown in FIG. 8.

Alternatively, the antenna may have a plurality of probes of different types. An antenna according to the invention may be used as:

- a high frequency antenna with a high bit rate, owing to its ability to operate at high frequencies thanks to multilayer deposit techniques;
- an antenna for on-board applications of the aerospace or military type, for example, owing to its compact size and its stealth characteristics resulting from the narrowness of its pass band;
- antenna with a conventional aperture to replace antennas with known apertures of the dish type or lens type.

What is claimed is:

1. Antenna comprising at least one probe (10) capable of transforming electrical energy into electromagnetic energy and vice-versa, characterised in that it further comprises an assembly (20) of elements made of at least two materials differing in their permittivity and/or permeability and/or conductivity, within which said probe is arranged, the arrangement of the elements in said assembly ensuring radiation, and spatial and frequency filtering of the electromagnetic waves produced or received by said probe, said filtering allowing in particular one or more operating frequencies (f) of the antenna within a frequency band gap, and in that it further comprises a planar reflector of electromagnetic waves (30; 30*a*) supporting said probe and placed in contact with said assemble of elements.

2. Antenna according to claim 1, characterised in that said assembly (20) of elements has a periodicity with at least one dimension and at least one defect (21) in one of these dimensions, the elements continuing to be disposed at a regular spacing in the other dimensions.

3. Antenna according to claim 1, characterised in that said assembly of elements (20) comprises a first material of a given permittivity and permeability and conductivity, forming at least one cavity (21; 21*a*) and a structure (22) made up of two other materials (23, 24; 25, 26; 27, 28; 23*a*, 23*b*, 24*a*) which differ in their permittivity and/or permeability and/or conductivity, said structure having a triple periodicity in three distinct spatial directions.

4. Antenna according to claim 3, characterised in that the structure (22) comprises metal bars arranged with a two- or three-dimensional periodicity.

5. Antenna according to claim 1, characterised in that said assembly of elements (20) comprises a material of a given permittivity and permeability and conductivity, forming at least one cavity (21; 21*a*) and a structure (22) made up of two materials (23, 24; 25, 26; 27, 28; 23*a*, 23*b*, 24*a*) which differ in their permittivity and/or permeability and/or conductivity, said structure having a double periodicity in two distinct spatial directions.

6. Antenna according to claim 1, characterised in that said assembly of elements (20) comprises a material of a given permittivity and permeability and conductivity, forming at least one cavity (21; 21*a*) and a structure (22) made up of two materials (23, 24; 25; 26; 27, 28; 23*a*, 23*b*, 24*a*) which differ in their permittivity and/or permeability and/or conductivity, said structure having a single periodicity in one spatial direction.

7. Antenna according to claim 6, characterised in that said assembly of elements comprises a first flat layer of material (21*a*) of a given permittivity and permeability and conductivity, inside which is arranged the probe, said first layer being in contact with at least a succession of flat layers (23*a*, 23*b*, 24*a*) of materials differing in their permittivity and/or permeability and/or conductivity, arranged in a one-dimensional periodic pattern.

8. Antenna according to claim 7, characterised in that the shape of the flat layers is arranged so as to obtain the desired radiation and gain diagram in accordance with radiant aperture theory.

9. Antenna according to claim 7, characterised in that the probe of the antenna is by nature capable of generating linear or circular polarisation in the antenna, causing it to operate either by linear polarisation or by circular polarisation.

10. Antenna according to claim 7, characterised in that the assembly has multiple periodicity defects which make it possible to widen the pass band of the antenna and/or create multiband antennas.

11. Antenna according to claim 1, characterised in that the probe of the antenna is by nature capable of generating linear or circular polarisation in the antenna, causing it to operate either by linear polarisation or by circular polarisation.

12. Antenna according to claim 1, characterised in that the elements which make up the structure (22) are coaxial cylinders made of materials with a forbidden photon band having periodicity in two or three dimensions.

13. Antenna according to claim 1, characterised in that at least one of the materials has dielectric and/or magnetic characteristics which are variable as a function of an external source such as an electrical or magnetic field, so as to make it possible to construct tuneable antennas.

14. Antenna according to claim 1, characterised in that the assembly has multiple periodicity defects which make it possible to widen the pass band of the antenna and/or create multiband antennas.

15. Antenna comprising at least one probe (10) capable of transforming electrical energy into electromagnetic energy and vice versa, characterised in that it further comprises an assembly (20) of elements made of at least two materials differing in their permittivity and/or permeability and/or conductivity, within which said probe is arranged, the arrangement of the elements in said assembly ensuring radiation, and spatial and frequency filtering of the electromagnetic waves produced or received by said probe, said filtering allowing in particular one or more operating frequencies (f) of the antenna within a frequency band gap, and in that it further comprises a planar reflector of electromagnetic waves (30; 30*a*) supporting said probe and placed in contact with said assembly of elements and in that the antenna comprises a metal plate forming the planar reflector (30*a*) on which is arranged the probe (10; 10*a*), said metal plate being in contact with a first flat layer of material of a given permittivity, permeability and conductivity, the thickness $e_1$ of said first flat layer being given by the equation $e_1 \sim 0.5\ (\lambda/\sqrt{\epsilon_r \mu_r})$, said first layer itself being in contact with a succession of flat layers of materials (23*a*, 23*b*, 24*a*) differing in their permittivity and/or permeability and/or conductivity, the thickness e of each of said flat layers being given by the equation $e_1 \sim 0.25\ (\lambda/\sqrt{\epsilon_r \mu_r})$, where $\lambda$ is the wavelength corresponding to the operating frequency (f) of the antenna wanted by the user, $\epsilon_r$ and $\mu_r$ being, respectively, the relative permittivity and the relative permeability of the material of the flat layer in question.

16. Antenna according to claim 15, characterised in that the shape of the flat layers is arranged so as to obtained the desired radiation and gain diagram in accordance with radiant aperture theory.

17. Antenna comprising at least one probe (10) capable of transforming electrical energy into electromagnetic energy and vice versa, characterised in that it further comprises an assembly (20) of elements made of at least two materials differing in their permittivity and/or permeability and/or conductivity, within which said probe is arranged, the arrangement of the elements in said assembly ensuring radiation, and spatial and frequency filtering of the electromagnetic waves produced or received by said probe, said filtering allowing in particular one or more operating frequencies (f) of the antenna within a frequency band gap, and in that it further comprises a planar reflector of electromagnetic waves (30; 30*a*) supporting said probe and placed in contact with said assembly of elements and in that the elements which make up the structure (22) are homogeneous coaxial cylinders surrounding the probe, the arrangement thus having radial periodicity, and in that the inner cylindrical element forms a cavity receiving said probe.

* * * * *